United States Patent [19]

Reuting

[11] 4,058,783

[45] Nov. 15, 1977

[54] RAPID ACTION RELAY

[75] Inventor: Hans-Werner Reuting, Peine, Germany

[73] Assignee: Elmeg Elektro-Mechanik GmbH, Peine, Germany

[21] Appl. No.: 631,746

[22] Filed: Nov. 13, 1975

Related U.S. Application Data

[62] Division of Ser. No. 485,322, July 3, 1974, Pat. No. 3,949,332.

[30] Foreign Application Priority Data

July 9, 1973 Germany ..... 2334838

[51] Int. Cl.[2] ..... H01F 7/08

[52] U.S. Cl. ..... 335/276; 308/62; 335/128

[58] Field of Search ..... 335/276, 269, 128, 81; 308/62

[56] References Cited

U.S. PATENT DOCUMENTS

| | | | |
|---|---|---|---|
| 2,946,876 | 7/1960 | Lockwood et al. | 335/276 |
| 2,975,252 | 3/1961 | Juptner | 335/81 |
| 3,195,420 | 7/1965 | Johannsen | 308/62 |
| 3,253,195 | 5/1966 | Fischer | 335/276 |
| 3,321,722 | 5/1967 | Cohen | 335/128 |
| 3,325,660 | 6/1967 | Boyer | 335/276 |
| 3,384,848 | 5/1968 | Weathers | 335/276 |

*Primary Examiner*—Harold Broome
*Attorney, Agent, or Firm*—Ralf H. Siegemund

[57] ABSTRACT

The relay as disclosed has a pivotable armature with self-balancing action and electromagnetic action which produces uniformly directed position changing action.

7 Claims, 1 Drawing Figure

RAPID ACTION RELAY

This application is a division of Ser. No. 485,322 filed July 3, 1974, now U.S. Pat. No. 3,949,332.

BACKGROUND OF THE INVENTION

The invention relates to an electomagnetic relay, including an armature being of the type that is, for example, adapted to adhere in the non-excited state to permanently magnetized poleshoes and contact springs actuated by the armature.

Magnetically polarized relays of this type are known. In such a case one or more permanent magnets are introduced into the magnetic circuit or circuits. The permanent magnet generates a flux in each of two magnetically conducting paths, which can be completed via an armature. In order to be able to move the armature and the contacts actuated thereby from one position to the other, an excitation field generated by a relay coil is superimposed on the field due to the permanent magnet. The advantage of such a relay resides in the fact that after switching over the contacts remain in their switched position owing to the adhesive forces due to the permanent magnet or magnets, without any need for further external exitation of the relay coil.

In order to ensure trouble-free functioning of such relays, care must be taken to ensure that on the one hand the sum of the magnet forces — i.e. the forces exerted by the permanent magnet or magnets on the armature — and the spring forces at any position of the armature always works in the direction of the poleshoes nearest the armature. This total force must be particularly large, especially at the two end positions of the armature, otherwise there is no guarantee that the armature would adhere properly in its position of rest. Although at some distance from the poleshoe, the total force decreases, it should not change its sign; otherwise, when lifting away only slightly from its end position and subjected to a mechanical shock, the armature could not be relied on to return to its end position and the switching position would change, a state of affairs which should not be brought about by mere mechanical shock. On the other hand, care must be taken to ensure that the sum of the excitation force — i.e. the force resulting from the excitation and the permanent premagnetization and acting on the armature depending on the position thereof — and the spring force works in such a direction during the whole of the stroke of the armature that it continues to the other end position. Only in such case do, in fact, forces obtain an excitation over the whole stroke of the armature, causing it consistently to move in the same direction. These conditions in respect of the permanent magnet force, the spring force and the excitation force are met when the curve of the spring force exerted on the axle determining the path of the armature lies between the curve of the permanent magnet force and the curve of the excitation force, without any of these curves intersecting.

With conventional relays, attempts are made in the interest of higher sensitivity to bring the curves of permanent magnet force and excitation force as close as possible to one another. These latter curves represent magnetization force vs. armature displacement. As however the (reflected) curve of the spring force must lie between them, it must be very accurately adjusted to the shape of the curves of the two magnetic forces. The spring characteristics must not intersect the magnetization vs. displacement characteristics as such intersection would mean a reversal of forces acting on the armature. As the magnetization curves are normally sharply curved, attempts have been made to effect this adjustment by the use of progressive springs which are difficult to manufacture. More often the rapid increase of the magnetic forces, as the end stop position is approached, has simply been limited by giving the magnet system the highest possible internal resistance.

A high internal magnetic resistance is achieved in the first place by the use of a permanent magnet of considerable effective length, thus making it needlessly bulky and expensive, and/or by operating the soft iron magnetic circuit at a high magnetic saturation, and/or by introducing into the magnetic circuit an additional air gap apart from the actual working air gap. By these means the shapes of the curves of permanent magnet force and excitation force are made flatter, so that one can make do with simple springs having linear characteristics.

A serious drawback of such high internal magnetic resistance resides in the tight spacing between the curve of the spring force from the curve of permanent magnetic force on the one hand and from the curve of the excitation force on the other hand, the latter representing the total effective force in the circumstances of electromagnetic energization of the relay. In the non-excited condition, the relay has little holding power when the armature is in the end stop position and is available for small power returning the armature to that position, if it has been lifted off e.g. on account of vibration. When the relay is excited, a small quantity only of energy is imparted to the armature, so that not only is the switching time prolonged, but most important of all, the speed with which the contacts open is slowed down, which increases the degree of burning of the contacts and consequently leads to a shortening of the useful life of the relay.

The feature which has the most decisive disadvantageous effect is the fact that the excitation flux also has to pass through the relatively elongated permanent magnet having a soft iron magnetic circuit operated at high saturation and/or through the additional air gaps, which requires a disproportionately greater magnetic flux to overcome these magnetic resistances and nullifies the gain in sensitivity aimed at and, consequently, results in a comparatively insensitive relay.

Relays constructed under the above-described principles thus result in constructions which, despite considerable attention devoted to adjustment, are sensitive to shock and have a relatively low switching speed, because the magneto-motive forces in the working air gaps were, in fact, kept at a very low level; nevertheless, the relays are comparatively insensitive, because a very much greater proportion of the excitation magnetic flux is uselessly dissipated in the magnetic circuit. The drawbacks of the known methods are, however, much more far reaching, as has been disclosed in numerous publications concerning efforts to remove these drawbacks.

The risk of intersection of relevant characteristics becomes greater the more attempts are made to render the relay more sensitive in this way, i.e. by bringing the curves of permanent magnetic and excitation force closer together. If, in fact, the curve of permanent magnetic force is shifted to lower levels owing to leakage of the magnetic properties or the like, the curves intersect immediately. This has lead to numerous efforts to compensate the magnets by temperature compensation etc. which is a very arduous procedure. Intersection of curves similarly occurs between the mirror image of the curve of the spring force and the curve of the electromagnetic excitation force, if during the operating period even only moderate burning of the contacts takes place. During burning of the contacts, the points of contact making and breaking actually shift, i.e. the points en route to which the spring forces are decreasing to zero so that during this time the springs are subject to decreasing tension. Consequently, the spacing between the mirrored spring force curve and the permanent magnet curve and consequently latterly the adhesive force becomes larger, while the spacing from the excitation force is exceeded.

The shifting of the curve or characteristics of spring pressure due to burning at the contacts is highly undesirable, since any permanent adjustment is out of the question. Moreover, when using a progressive spring system, the characteristic of which is continually changing, it is never known exactly where the intersection will arise. If it is situated in the vicinity of the armature and stop positions, the relay does not switch at all. If it lies somewhere between the end stops, then the relay is uncertain in operation. A mere shock or friction may cause it to fail and the armature will come to rest in an unwanted switching position. This faulty operation happens usually where the contacts remain closed under the smallest contact pressure.

If the armature does not come to rest, it will move in a sporadically, creeping fashion. If the contacts are operating under a high loading such creeping has a particularly disastrous effect on their condition. In order to avoid intersection of spring and magnetization characteristics resort is had to higher excitation capacities, but then the operating voltage must be readjusted from time to time by the user. This is a very unrealistic requirement. Consequently, when attempting to work at the specified and advertised response sensitivity, suitable additional precautions have to be taken at the outset, so that the lower excitation loading which is usually bought at considerable expense cannot be made use of at all.

It follows from the foregoing that the adhesive force cannot even be stated with any degree of reproducible accuracy with such relays. The response sensitivity can be defined with some sort of accuracy only, because it depends only in part on the magnetomotive driving power and is determined to a predominating extent by the resistance of the magnetic circuit. The result of this is that when operating at levels above or below the rated excitation, it is quite impossible to predict how the relay will behave, because, — especially when manufacturing tolerances, saturation phenomena, the temperature dependency of the material from which the magnetic circuit consists come into play — an indefinite fraction only of the excitation power can be made effective for the generation of magnetomotive force. The adhesive force and relay behaviour are the less defined with regard to changes in the response excitation, the greater are the efforts made to adjust the shape of the curve of spring power to the shape of the curve of permanent magnet force, in order to make the relay sensitive. Fluctuations in the permanent and/or spring power of a few percent give rise to considerable variations in the adhesive force and also of the effective excitation required, owing to the effect of the disparity.

However, all such relays which have been made sensitive by causing the curve of spring force to conform closely to the curves of permanent magnet force and the excitation force have the fundamental drawback that over long stretches of the stroke of the armature the difference between the spring force and the excitation force is small, causing the force/stroke-integral, which defines the kinetic energy transmitted to the armature, to be small. This once again means relatively slow switching times and low speeds of contact separation.

For reasons of symmetry, relays with permanent magnetization and particularly for pulse operation and depending on direction of energization upon the desired switching state to be attained, are constructed with a swivel or pivotal armature, wherein each end of the armature abuts to poleshoe structure in each of the two switching states and positions; that is to say, such abutment is supposed to occur; otherwise the adhesive force will differ from the desired condition.

Journalling of the pivotal armature is absolutely necessary in numerous applications, invariably for example when importance is attached to signal sequence-controlled contact. On the other hand, however, owing to the journalling of the pivotal armature, the problem arises that when it is in contact with two of its abutting surfaces, the position of the armature is invariably overdefined or controlled from the static point of view. This is because in such a position the armature is not only supported at its pivotal axis, but also by the abutting surfaces, resulting, therefore, in a three-point support.

It may now happen that the rotational axis of a pivotal armature so mounted in a relay is not in absolutely accurate alignment with the abutting surfaces; the armature does not, therefore, come into perfect contact with the abutting surfaces so leaving undesirable gair gaps. Manufacturing and assembly tolerances must inevitably be taken into account during the manufacture of such relays and as a rule there is no guarantee that the rotational axle of the pivotal armature will, in fact, be accurately journalled in its bearings. On the other hand, however, it is usually very difficult to correct the disposition of the rotational axle, particularly when the pivotal armature is mounted in an aperture made in the carrier carrying the relay coil.

It can readily be seen that uncertainty in the engagement between both ends of a swivel armature and the poleshoes, compounds the problems regarding magnetic attraction vs. displacement characteristics as outlined earlier.

DESCRIPTION OF THE INVENTION

It is an object of the present invention to provide for a new and improved relay which combines balanced operation with rapid action.

It is another object of the present invention to provide a relay biased by means of permanent magnetization and in which the holding action of the bias is readily overcome upon electromagnetic energization.

It is still another object of the present invention to provide a relay in which the holding force is the resultant of permanent magnetic bias and (subtractive) contact pressure as provided by resilient reaction of spring biased contacts, wherein the contact pressure force will never exceed the bias.

It is a further object of the present invention to provide a relay with balanced action pivot or swivel armature.

It is a still further object of the invention to provide a new and improved relay having a swivel armature whose ends are to abut poleshoes in both of two switching positions with certainty.

It is a particular object of the present invention to improve a relay with permanent magnetic bias, energizing coil and resilient contact loading for a pivotable or swivel armature having two switching positions and changing positions by particularly directed current pulses through the coil.

In accordance with the preferred embodiment of the invention, it is suggested to provide a relay of the type referred to above with such a magnetic circuit having a yoke structure which, in combination with a permanent magnetic bias and the armature, has a characteristic of attraction which is highly nonlinear, with little attraction in median positions between two stop positions of abutment of the armature with the yoke structure, and very strong attraction when in the vicinity of the stop positions. The coil is to be energized so that the magnetic attraction is just overcome when the armature is in one or the other stop positions and is propelled from that position towards the other one. The contacts as engaging in either stop position are resiliently biased, tending to remove the armature from the respective stop position, and upon electromagnetic energization the propelling force of the latter is added to the spring force of the spring bias and loading. The resilient reaction characteristics of the spring contacts varies preferably linear with displacement and for the ranges of contact making, and these characteristics are preferably tangent or close to the characteristics of permanent magnetic bias without electromagnetic energization. The armature has a shaft and is journalled in excentric disks to obtain self-balancing of abutment of both ends of the armature with the yoke structure, in both stop positions.

Broadly speaking, it is suggested to provide for a magnetic reluctance of the magnetic circuit, as far as established by the ferromagnetic material, which is very small as compared with the magnetic reluctance in the operating air gap as between poleshoes and armature, using here large cross-sections and, possibly, magnetic shunts running parallel to the permanent magnet that biases the magnetic circuit. Specifically, the total reluctance through solid material of the magnetic circuit should not exceed 1/5 of the reluctance in the working air gap. Preferably, the ratio should be even smaller than 1/10. The electromagnetic energization is selected so that the armature will be accelerated at maximum possible force, particularly between the period of lifting from an engaging disposition up to the point of contact opening. In particular, the resulting magnetic force, composed of permanent magnetic force and electromagnetically produced force, should not change direction upon turn-on of the electric current in the relay coil but should act in the same direction as the now relaxing contact spring or springs accelerate the armature towards a contact opening disposition and the alternative switching state.

It will be appreciated that symmetry of operation will depend to a considerable extent on comparable disposition of the armature arms in relation to the yoke structure, and here particularly regarding abutment of both arms in both of the two stop positions. If the armature is journalled in excentric disks, this balance in position can be obtained by rapid action alternation between the two armature position, thereby shifting the journal axis until both armature ends do abut the yoke structure in both switching positions. In any situation where the armature abuts the yoke structure with one arm only, the point of abutment acts as fulcrum and acts strongly on the journal disk. Rapid action rocking of the armature will result in a torque on the disks for turning them thereby shifting the journal axis until both arms of the armature abut the yoke structure in each stop position.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
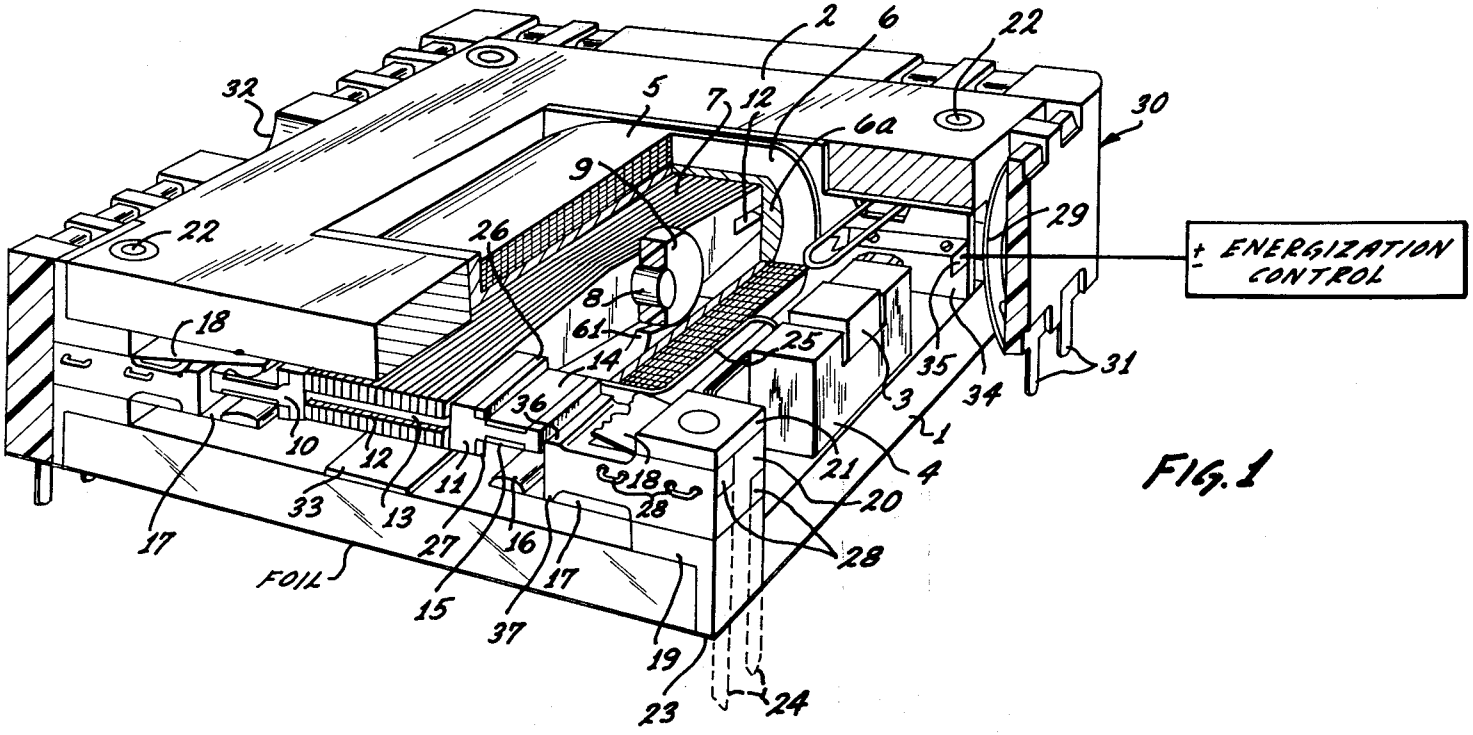
FIG. 1 is a perspective view of a relay in accordance with the preferred embodiment of the invention showing partially broken open portions to permit viewing of the interior.

Proceeding now to the detailed description of the drawings, the relay illustrated has two quadrilateral yokes 1 and 2, which could be regarded as rings or annuloids of rectangular contour, each yoke having four legs accordingly. A permanent magnet 3 and an intermediate piece 4 is disposed between two adjacent legs of yokes 1 and 2, there being a corresponding assembly interposed between the two oppositely located legs of the two yokes. These intermediate pieces 4 function as spacers and are quite accurately machined. The same is true for the magnets 3, so that the distance between the two yokes 1 and 2 is accurately determined therewith.

A bobbin or coil carrier 6 is disposed in the open space in and as between the central portions of yokes 1 and 2; this carrier 6 carries an energizing coil 5, while a pivoting armature 7 is disposed inside of bobbin 6. Armature 7 has a shaft or axle 8 for journalling the armature in plastic aperture disks 9. These disks are mounted in carrier 6. The armature 7 can pivot in one or the opposite direction and its extremeties or arm ends can engage diagonally opposed yoke legs, serving as pole shoes accordingly.

As all parts are circumscribed by the yokes, they can generally be made relatively wide especially in the region of the permanent magnets, so that the thickness of the latter which must be of a definite volumetric capacity, can be kept relatively small. This offers a number of significant advantages; among them is that these permanent magnets may have a relatively low magnetic internal resistance, which is important from the point of view of increasing the sensitivity of the relay. Since the permanent magnets are actually situated in the magnetic circuit of the excitation flux, that flux would have to be made greater in proportion to any increase in the magnetic resistance in the magnetic circuit.

The gap between the two yokes needs only be partly filled by the flat permanent magnet 3, the remainder being occupied by soft iron parts 4. In such a case, the thickness of the permanent magnets and that of the soft iron parts determines the spacing between the yokes 1 and 2. In view of the ample space made available by the use of wide yokes, the soft iron parts may in this case be designed so as to form a magnetic shunt; by this means the smallest possible magnet volume and the lowest possible internal resistance of the permanent magnet system situated between the yokes may be arrived at for a given relay by suitable optimization.

The two ends of armature 7 each carry two laterally extending contact actuators 10 and 11, made e.g. of plastic material. These actuators are secured to the respective armature arm by means of a magnetizable rod or bar 13, which is inserted in a slot 12 at the particular armature end. Each of the actuators 10 and 11 has a contact surface 14 on its respective upper or top side, and another contact surface 15 on its lower side. Hence, these contact surfaces are moved up and down on pivot motion by the armature 7 and constitute non-captive contacts. The entire arrangment has eight such contact surfaces, the sub-assembly as illustrated in the front of the perspective illustration is duplicated in the rear.

Each contact surface on the rocking or pivoting armature cooperates with a stationary contact 16 having curved, cylindrical contour as facing the respective armature contact. Contacts 16 are stationary in the sense that they are not mounted on the armature, but they are displaceable due to mounting on leaf springs, such as 17. A leaf spring 18 is shown partially, carrying also a contact, such as 16, which cooperates with a contact surface 14 on an upswing of the armature.

Due to the swivel, pivot or rocking motion and displacement of the armature, one arm of the armature will deflect two springs 17, while the other arm deflects two springs 18, with a reversal of deflection action on pivoting to the respective other position. The illustrated position of the armature shows the end which is visible in the front due to perspective illustration, in up position, so that contact carriers 10, 11 deflect the two visible springs 18. The rear end of the armature is down accordingly and has deflected the two springs corresponding to 17. Each armature end does not abut a yoke leg directly, but sits on a stop sheet 33.

The relay has four corner assemblies, one assembly being shown in greater detail and being comprised of spacer pieces 19, 20 and 21. These leaf springs 17 and 18 are secured to these spacer assemblies. These assemblies actually serve as mounting structures in that rivets, such as 22, hold spacer assemblies and yokes together in the four corners. The springs are mounted with the assembly in that fashion and the rivets force super-imposed parts together. Not all of the spacers 19, 20, 21, springs 17, 18 and yokes 1 and 2 have all of the illustrated recesses and protrusions in all four corners.

One protrusion or extension is, for example, flange part 23 being inserted in an appropriate recess in the one corner of yoke 1 and providing also electrical insulation relative thereto. Rear end continuations 24 of the contact springs may be run down at that point. The spacer 21 may be provided with a similar flange inserted in a recess in yoke 2, but that may not be necessary.

The contact springs 17 and 18 have similar contour each with a laterally offset rear extension 24 and since the contacts 16 of two springs 17, 18 face each other, the narrower extensions 24 have necessarily a lateral distance from each other. Since in this manner the width of such a contact spring extension 24 is invariably only a small fraction of the width of the springs themselves, in the case of facing contact surfaces of two springs, the extensions thereof are always spaced from one another, which ensures trouble-free electrical connection. If in this connection two contact springs 17, 18 with facing contacts 16 are provided at each corner of the relay, all springs mounted at the corners have coincident contours, so that only a small number of different components are required, which brings further advantage to the sandwich method of construction. Should more than two contact springs with facing contact surfaces be required at the corners, the extensions or leads can be mounted at right-angles to the longitudinal edges of the contact springs, so that they can then be led out by another lateral surface of the relay.

The rivetting of the yokes to each other provides also for positive positioning of carrier 6 inside of the structure. The carrier has projections, such as projection 34 of the coil flange bearing against the yokes 1 and 2. The particular projection 34 is also provided with an electric connection 35 for coil 5 runs to the outside of the assembly.

Each contact surface 14 and 15 is connected to an elongated supple spring, such as 25, running parallel to the armature and providing current to the respective contact surfaces. The spring doubles back and is run to the outside through the respective, associated corner piece 20.

Each actuator 10 and 11 has additionally two permanent magnetics 26 and 27 providing one magnetic flux component in direction of the respective contact surfaces 14 and 15. These particular flux components establish a force acting on an arc or spark between a contact surface on the one hand and its respective counter contact 16 on the other hand and in direction of longitudinal extension of that counter contact so as to drive the spark in axial direction as far as the cylindrical contour of the contact 16 is concerned. Therefore, such an arc will not remain stationary at the point of development and will not burn a hole. Rather the arc will migrate along the contact surfaces and will not unduly heat anyone spot. Damage is avoided or at least minimized by such a provision.

In lieu of the two small permanent magnet rods 26, 27, one can construct rod 13 as permanent magnet. Still alternatively, if the rod 13 is made of soft magnetic material, stray and leakage flux can be put to use and is appropriately run into such rod to obtain the same effect of moving an arc over the contact surfaces.

Owing to the relatively large cross-section of the yokes and of the armature made possible by the construction and technique of the invention, permanent magnets do not produce any detrimental effects on the contact actuating members in respect of a too rapid saturation of the flux path provided for the adhesion of the pivotal armature and for the actuation thereof.

The ends of contact springs 17 and 18 as well as of springs 25 are all constructed to lead to connections 28 in and at the respective closest corner element 20. These connections 28 may be connected to or engage springs 29 of a plug connector 30. The connector 30 is constructed as a frame into which the entire relay yoke structure has been inserted. The springs 29 are equipped with soldering pins or lugs 31, which can be soldered onto a printed circuit board.

The plug connector 30 is constructed as a frame and has adequate dimensions for receiving the yokes as riveted together. The height or depth of that frame should not exceed the height of the yoke assembly. This way, no additional head room has to be provided for, the frame 30 as circumscribing the yoke assembly encases the yoke assembly and the top and bottom opening of the yoke structure may be covered by a thin foil. The yoke assembly may be just stuck into the frame, and two of its sides cover the laterally open space between those yoke legs which serve as pole shoes. Two opposite sides of frame 30 have recesses 32, so that the yokes as assembled can be gripped by at least one yoke, so that the yoke assembly can be removed from the frame.

The legs of the yoke themselves cover all contact-making parts of the relay and are relatively wide. This wide construction does not only serve as protection, but the permanent magnets 3 may also have very large base surfaces and offer, therefore, very small internal resistance (reluctance). As stated, the magnetizable spacers 4 provide for a magnetic shunt path which reduces the magnetic resistance regarding energizing flux still further, while the volume of magnetized material is quite small. The sensitivity of the relay benefits greatly from this feature.

Another advantage of the wide yoke legs is that the rocking or swivel armature can be correspondingly wide. The operating air gap between armature and yoke legs has, therefore, quite a wide surface, and magnets of small height can be used which in turn renders the relay quite powerful, particularly with regard to contact pressure forces.

The wide armature and the wide actuators displace a relatively large amount of air when actuated. The armature is caused to pivot from one end position to the other one. If the relay construction is laterally closed that air must flow from one armature arm along the space between the contacts to the other arm. This flow dilutes the ionized plasma of a spark or arc and provides also for cooling of the contact surfaces along which such air is forced to flow. Still, residual air between the large surfaces which are moved towards each other cushion the impact of the respective armature end on the yoke. The separation or stop sheet 33, moreover, prevents direct impact on the yoke. This cushioning extends the life of the relay and of its contacts, and prevents bouncing of the armature as carrying contacts, so that contact bouncing on account of armature-yoke impact is impeded, indeed.

The wide construction of the yoke legs permits also utilization of wide springs 17 and 18. Hence, a relatively large quantity of air is present between each spring and the nearest yoke leg. This air dampens any displacement of the contact springs 17, 18 and that in turn impedes bouncing of the respective relay contacts. Besides, the springs are quite short and have accordingly a high spring resilient spring constant while contact pieces (16) plus spring have comparatively small mass. The relevant factors of such an oscillating assembly are, therefore, mutually reinforcing as to damping and are quite poor in performance for setting up of oscillations. The air cushion imposes additionally strong attenuation of mechanical oscillations, so that, indeed, there will be little, if any flutter and bouncing.

The contact surfaces 14 and 15 are secured to the armature in a manner which does not permit oscillations relative to the armature. The springs 25 are to have little resiliency. Thus, the armature plus contact actuators constitute an oscillation system, which is characterized by large mass and large magnetic forces. The effective inertia of the armature is so large, so that in the instant of impact of the contacts (14 or 15) on contacts 16, armature 7 continues its displacement, practically unimpeded. The large armature mass precludes all bouncing at this point. As the armature hits the yoke, i.e. stop sheet 33, maximum magnetic force exists in the circuit. These attracting forces hold the armature against reflective bouncing. Moreover, the air cushion did reduce the kinetic force of the armature right before the impact. Even a slight bouncing of the armature will not be effective and will be compensated by the resiliency of the mount of contacts 16, only the deflection of springs 17 and 18 may vary slightly but without causing the contacts to disengage and reopen.

It should be noted that one can increase the attenuation of springs 17, 18 still further by providing the corner elements 19 and 21 with inward projections to confine the air adjacent springs 17, 18 still further, so that more tortuous paths for air between springs and yokes are provided therewith, and cushioning is enhanced accordingly.

Still further increase of contact spring damping is possible by placing e.g. a foam material between springs and yoke, filling that space and cushioning any spring deflection still further.

The corner pieces 20 are constructed to prevent springs 17 and 18 from following the contact surfaces 14 or 15 upon opening action of the relay contacts. For this, ridges 36, 37 are provided on an inward extension of corner piece 20. These ridges shorten the spring arm length to such an extent that they hold the spring with contact 16 in position particularly upon opening contact action. These stops do not interfere with desired flexing of each contact on a spring 17 or 18 once engaged, and as the armature continues to move until hitting a pole shoe - stop sheet, the flexing of the springs 17, 18 produces the desired contact pressure.

An advantageous feature of the uni-directional resiliency as imparted by the stops 36, 37 upon the contacts 16 on springs 17, 18 is that upon abutment, they will open rapidly without tendency to reclose once disengagement has been effected, as the stops impede further movement of contacts 16. On the other hand, the contacts may be welded and together! As the armature pivots to switch over, the springs welded to one or more of the corresponding contact surfaces provided on the contact actuating members 10, 11 can only be carried by said contact surfaces as far as the stops on the middle spacer piece will permit. At this moment any further armature movement is blocked, if the axle thereof is mounted with sufficient play. Accordingly, the oppositely facing contact surfaces on the contact actuator, not being welded, cannot touch their counter-contacts 16 and thus no previously open contacts can be closed.

Turning now to specifics of mounting of the armature, shaft 8 is preferably a magnetizable rod inserted into the usually laminated armature to provide positive support for the armature but without any significant interference with the magnetic flux in the armature.

At least the ends of the shaft are round for journalling in the disks 9. There should be no play between rod 8 and armature 7, so that keying here is advisable. The disks 9 are made of plastic and provide some resiliency in the mounting of the armature in coil carrier 7.

The armature ends are pulled against yoke legs in each end position by means of rather strong magnetic forces as stated above. If the armature shaft is not accurately positioned, only one end of the armature could positively engage the respective stop sheet 33, while the other arm end may still have a certain distance from the respective yoke leg and particularly from its stop sheet. This unbalanced state of armature abutment would produce an additional and undesired air gap at that point. Moreover, the one-sided support of the armature on the yoke would load the shaft 8 under lever arm action (at about half the lever length as measured from one end to the other) and at twice the action force effective between the engaging armature end and the respective yoke leg. Moreover, when both armature ends are not abutting the respective stop sheets, the magnetic balance of the system is disturbed and the flux distribution will not be symmetrical. It is for this purpose that the shaft 8 is journalled in disks 9 which have an excentric configuration, that is to say, these disks have a non-concentric circular periphery with regard to the respective journal aperture. This way, the disks will turn inside carrier 6 until both ends of armature abut the respective yoke legs, and no pressure is exerted on the axis.

Some details should be considered concerning placement of disks 9 inside of coil carrier 6. The carrier 6 is open to both sides to place the armature inside of the carrier. The openings face respectively the poleshoe gap as between those yoke legs against which the armature will abut. Of course, the armature ends will project always outside of carrier 6.

One of these openings in carrier 6 can be used to shift the disks 9 into the coil carrier, until abutting suitable stops, such as 61, provided e.g. as cut-outs, recesses, flanges, snap action stops or the like. These stops 61 prevent further shifting of disks 9, but permit their turning. In lieu of stops behind which the disks are placed by snap action, one could provide rails inside the carrier 6, which have been shifted into the interior of carrier 6 laterally (i.e. through the openings as provided for having the armature ends project out of the coil carrier). These rails are then fixed on the outside. The rails are constructed e.g. as two metal strips for each disk, and the disk is held in-between. After the rails, disks and armature have been shifted together into the carrier; they are fixed through fastening either to the coil carrier itself or to the yokes. One could also use a single rail for each disk with a blind bore for holding the disk. The mounting on rails is preferred as the friction between such mount and the disk is quite low.

After the disposition of the disk 9 has been adjusted as stated, one arm of the armature abuts stop sheet 33 on the one leg of yoke 1 while the other armature arm abuts the corresponding sheet on the diagonally opposed leg of yoke 2. This does not mean that both of the armature arms will respectively abut the respective other two yoke legs when the armature is being placed into the other end position! Such abutting position is obtainable if, in fact, the excenter disks turn also on each switching action; that, however, is not desirable.

In order to avoid disk turning on each armature pivoting, it is suggested to obtain proper adjustment by operating the relay at a rapidly varying energization in an initial adjusting procedure. This, in effect, produces shaking in the armature mount and will cause the excenter disks to assume a median position from which abutting armature dispositions are obtained for each and both of the two switching and end positions. Such self-adjustment will occur even if the magnetic forces are comparatively small and if friction of disks 9 in cradles **6*a* is high. The large inertia of the armature when actuated will, indeed, overcome friction, and rapid action will turn the disk 9, thereby pivoting the armature axis, until the forces acting on the armature and on shaft 8** in both switching positions will be equalized.

Pursuant to the rocking adjustment, the axis of the shaft 8 will assume a median orientation with regard to both end positions of the armature. It may then be advisable to place a curable glue adhesive between disks 9 and casing or carrier 6, which hardens during the rapid action armature operation so that the position of the disks 9 will be fixed and retained particularly after the rapid action adjusting operation has been terminated. The disposition of the armature axis is now fixed particularly for normal switching operations which will follow.

The adjustment of shaft 8 as obtained should not be influenced by elasticity of the coil carrier 6, or of the disks 9. Moreover, the shape stability of disks 9 must not be the cause for any elastic yielding of the carrier 6, particularly during the rapid action adjustment. Therefore, the carrier 6 is strengthened considerably in the bearing portions for disks 9. Moreover, that portion of carrier 6 bears against yokes 1 and 2. In particular, carrier 6 has two rather strong bars **6*a* extending in a direction transversely to the axis of shaft 8. These bars prevent flexing at the bearing locations of the disks. The bars 6*a* are rounded on the outside to permit more easy winding of the relay coils, particularly by automatic coil winding machines. Bars 6*a*** will actually extend beyond coil flanges and may be affixed (such as press fit through friction) between the yoke legs, serving as poleshoes, to obtain positive support of the coil carrier as a whole.

For purposes of adjustment one can replace the magnet forces by others or one can provide supplemental force here in order to better overcome any friction of the disk 9 when being turned in carrier 6. The result, of course, will be the same.

The invention is not limited to the embodiments described above, but all changes and modifications thereof not constituting departures from the spirit and scope of the invention are intended to be included.

I claim:

1. In a relay having a swivel armature, for pivoting about an axis and having two arms extending from the axis, the relay having additionally an enveloping energizing coil on a carrier and a yoke structure providing for abutment with the two arms of the armature, the armature having a shaft; the improvement comprising:

a pair of disks for journalling the shaft inside of the carrier, the disks journalling the axis of the shaft eccentrically to the circular peripheries of the disks, and the yoke structure establishing two positions of abutment for the armature, whereby the two arms respectively abut the yoke structure in two diagonally opposed dispositions in each of the two positions.

2. In a relay as in claim 1, the shaft being made of magnetizable material.

3. In a relay as in claim 1, the coil carrier being provided with stops for holding the disks.

4. In a relay as in claim 1, the coil carrier being provided with rail means for holding the disks.

5. In a relay as in claim 1, the disks being bonded to the coil carrier.

6. In a relay as in claim 1, wherein the disks are at least temporarily loosely seated in the carrier, so that upon rapid action alternatingly directed energization of the coil the disks turn relative to the carrier into a position, so that both of the armature arms will abut the yoke structure in both positions.

7. In a relay as in claim 6, wherein an adhesive material is provided between said disks and said carrier, being still liquidous but hardening during said rapid action energization deenergization.

* * * * *